US010272466B1

(12) United States Patent
Hung

(10) Patent No.: US 10,272,466 B1
(45) Date of Patent: Apr. 30, 2019

(54) CAULKING GUN

(71) Applicant: SIANG SYUAN FU ENTERPRISE CO., LTD., Changhua County (TW)

(72) Inventor: Hung-Chih Hung, Changhua County (TW)

(73) Assignee: SIANG SYUAN FU ENTERPRISE CO., LTD., Changhua County (TW)

( * ) Notice: Subject to any disclaimer, the term of this patent is extended or adjusted under 35 U.S.C. 154(b) by 0 days.

(21) Appl. No.: 15/895,271

(22) Filed: Feb. 13, 2018

(51) Int. Cl.
*B05C 17/01* (2006.01)
*B05C 17/005* (2006.01)

(52) U.S. Cl.
CPC .... *B05C 17/0116* (2013.01); *B05C 17/00596* (2013.01)

(58) Field of Classification Search
CPC ..... B05C 17/0116; B05C 17/00596
USPC ..... 222/326, 327, 386.5, 389, 390, 391, 466
See application file for complete search history.

(56) References Cited

U.S. PATENT DOCUMENTS 4,081,112 A * 3/1978 Chang ..... B05C 17/0123 222/391
7,334,709 B1 * 2/2008 Huang ..... B05C 17/015 222/334
7,850,045 B2 * 12/2010 So ..... A21C 15/005 222/132
8,006,867 B2 * 8/2011 Calvo ..... B05C 17/0123 222/391
9,737,904 B2 * 8/2017 Hung ..... B05C 17/00596
2013/0233892 A1 * 9/2013 Kimura ..... B65D 83/0033 222/333

* cited by examiner

*Primary Examiner* — Vishal Pancholi
(74) *Attorney, Agent, or Firm* — Muncy, Geisler, Olds & Lowe, P.C.

(57) ABSTRACT

A caulking gun is provided, including: a gun body, including a cartridge holder, the cartridge holder being adapted for receiving a caulk cartridge; a pushing rod, movably assembled to the gun body and extending into the cartridge holder, the pushing rod having a pushing portion which is movable within the cartridge holder and is adapted for pushing the caulk cartridge, and a hook pull portion connected with the pushing portion, the hook pull portion including a first hook portion and a second hook portion, at least one of the first hook portion and the second hook portion being movable to the other of the first hook portion and the second hook portion.

9 Claims, 6 Drawing Sheets

CAULKING GUN

BACKGROUND OF THE INVENTION

Field of the Invention

The present invention relates to a caulking gun.

Description of the Prior Art

A caulking gun is used to fill a gap of a corner of a wall or a gap between connections of two objects easily and conveniently.

A conventional caulking gun includes a cartridge adapted for receiving a caulk cartridge and a plunger disposed through the cartridge. The plunger is driven by a lever to be moved with respect to the cartridge. The plunger of the conventional caulking gun has a hook portion disposed at one end portion thereof. The plunger and the hook portion of the conventional caulking gun are integrally formed of one piece so that the hook portion cannot be folded and adjusted. Therefore, the conventional caulking gun is not convenient for carrying, storage, and using.

The present invention is, therefore, arisen to obviate or at least mitigate the above mentioned disadvantages.

SUMMARY OF THE INVENTION

An object of the present invention is to provide a caulking gun, which has two hook portions movable to each other.

To achieve the above and other objects, a caulking gun is provided, including a gun body, including a cartridge holder, the cartridge holder being adapted for receiving a caulk cartridge; and a pushing rod, movably assembled to the gun body and extending into the cartridge holder, the pushing rod having a pushing portion which is movable within the cartridge holder and is adapted for pushing the caulk cartridge, and a hook pull portion connected with the pushing portion, the hook pull portion including a first hook portion and a second hook portion, at least one of the first hook portion and the second hook portion being movable to the other of the first hook portion and the second hook portion.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
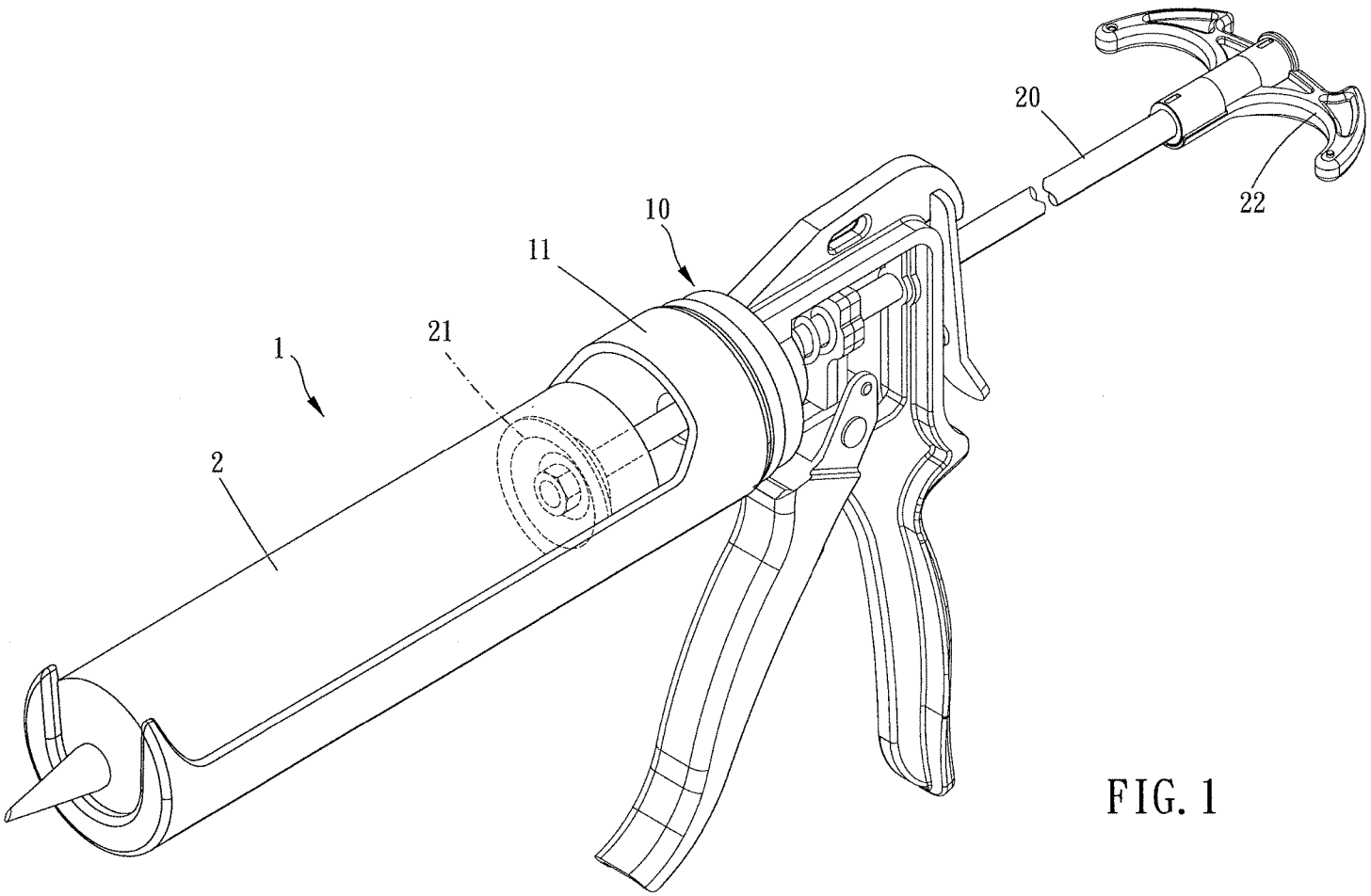
FIG. 1 is a perspective view of a preferred embodiment of the present invention.
Figure 2:
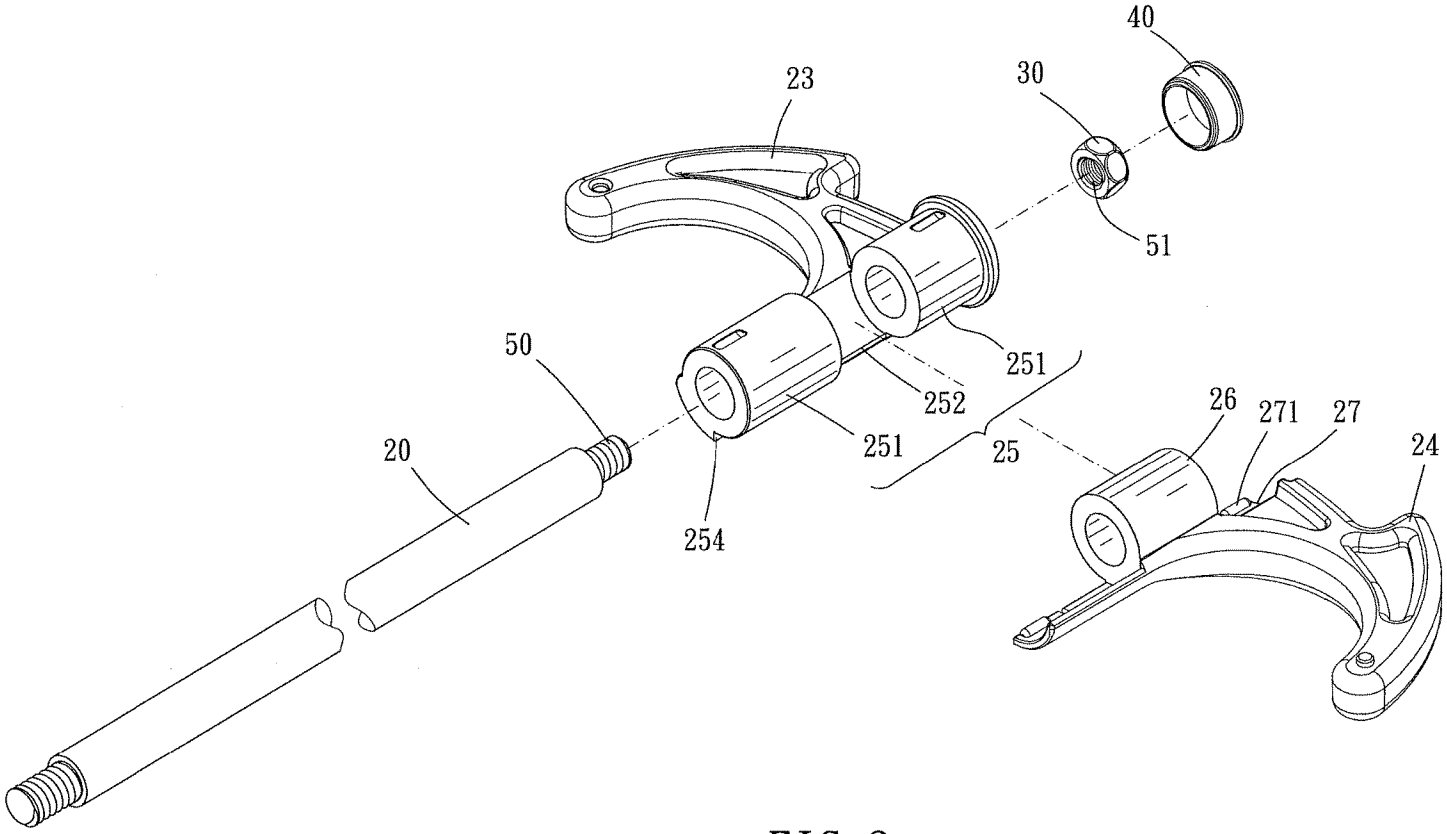
FIG. 2 is breakdown drawing of the preferable embodiment of the present invention.
Figure 3:
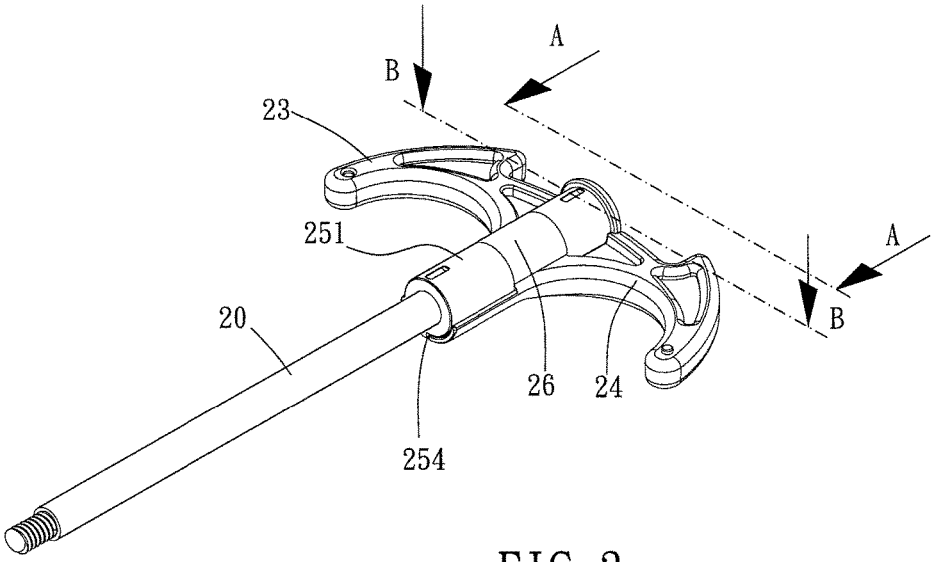
FIG. 3 is partial perspective view of the preferred embodiment of the present invention.
Figure 4:
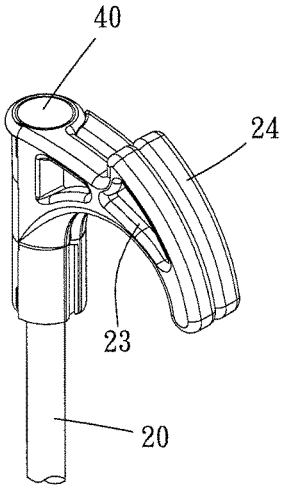
FIGS. 4 and 5 are perspective views of two hook portions arranged in folded position of the preferred embodiment.
Figure 5:
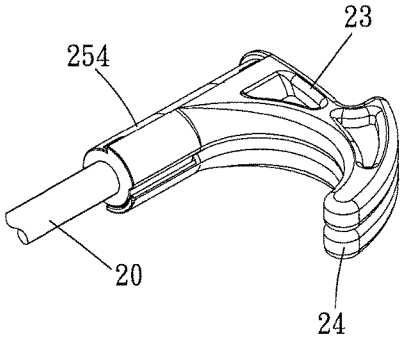
Figure 6:
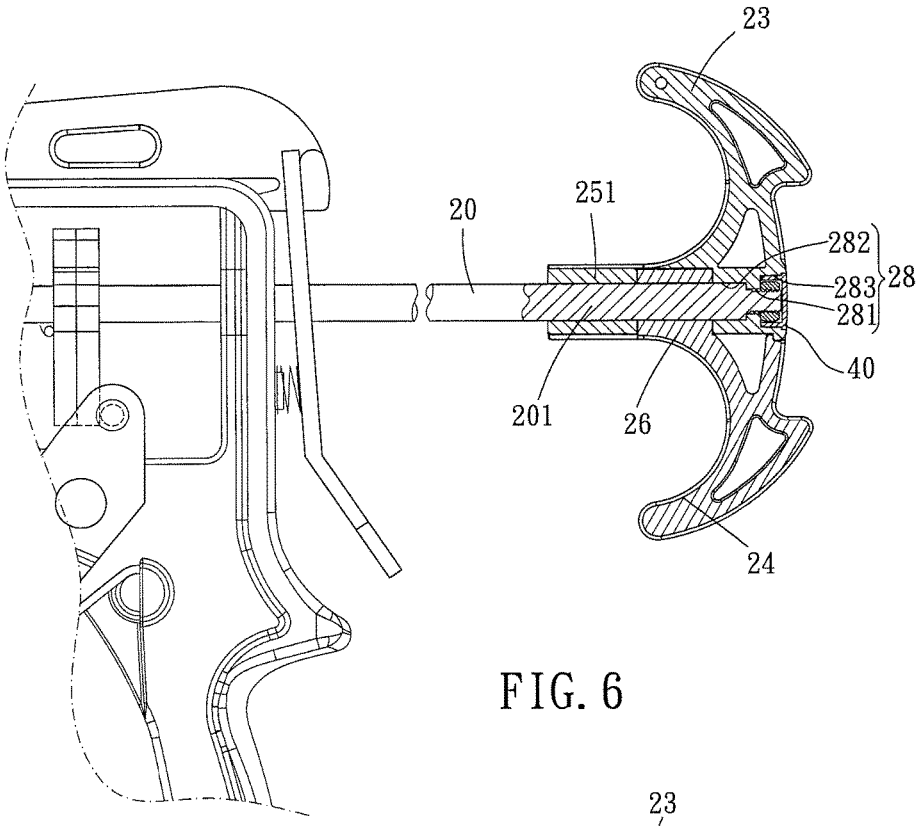
FIG. 6 is a cross-sectional view taken on line A-A of FIG. 3.
Figure 7:
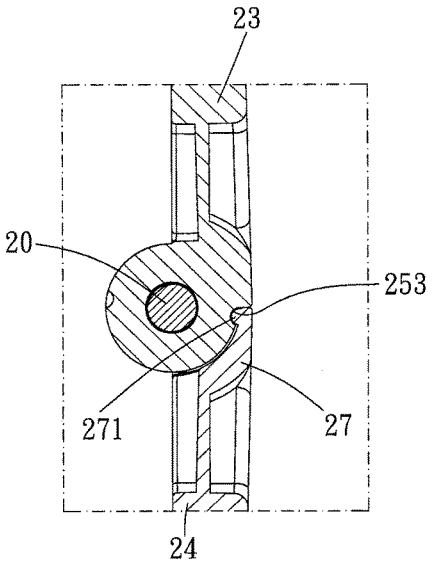
FIG. 7 is a cross-sectional view taken on line B-B of FIG. 3.

FIGS. 1 to 8 show a caulking gun according to a preferred embodiment of the present invention. The caulking gun 1 includes a gun body 10 and a pushing rod 20.

The gun body 10 includes a cartridge holder 11, and the cartridge holder 11 is adapted for receiving a caulk cartridge 2. The pushing rod 20 is movably assembled to the gun body 10 and extends into the cartridge holder 11. The pushing rod 20 has a pushing portion 21 which is movable within the cartridge holder 11 and is adapted for pushing the caulk cartridge 2, and a hook pull portion 22 connected with the pushing portion 21. The hook pull portion 22 includes a first hook portion 23 and a second hook portion 24. At least one of the first hook portion 23 and the second hook portion 24 is movable to the other of the first hook portion 23 and the second hook portion 24. Specifically, at least one of the first hook portion 23 and the second hook portion 24 can be translated with respect to the other of the first hook portion 23 and the second hook portion 24, such as in a perpendicular direction or a horizontal direction. Besides, at least one of the first hook portion 23 and the second hook portion 24 can be moved rotatably or swingly to the other of the first hook portion 23 and the second hook portion 24. In this embodiment, the second hook portion 24 is pivotally connected with the first hook portion 23, so as to adjust an included angle between the first and second hook portions 23, 24. Thus, it is convenient to use and operate through adjusting a relative position between the first hook portion 23 and the second hook portion 24.

Figure 8:
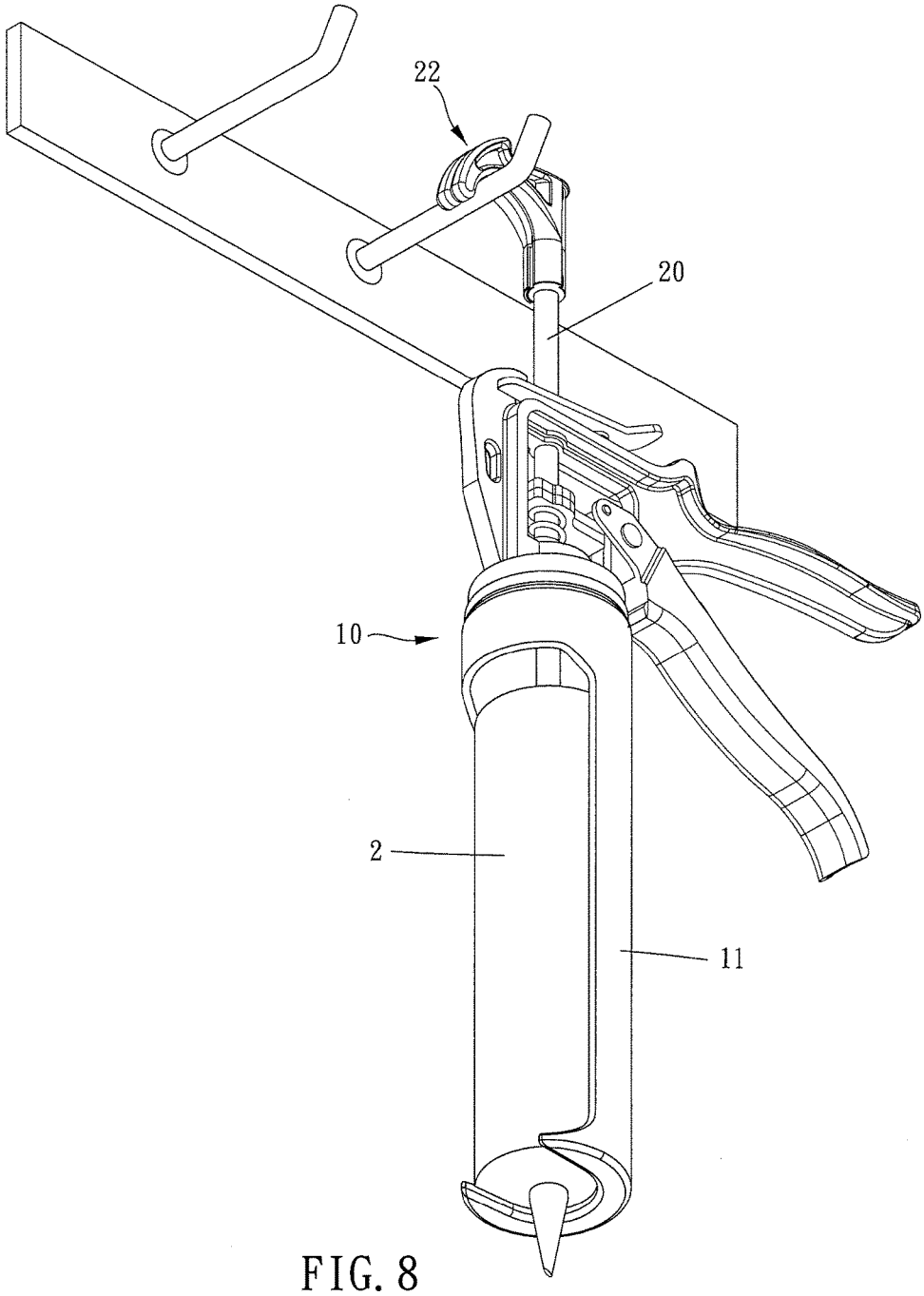
FIG. 8 is a perspective view of the preferred embodiment of the present invention in use.
Figure 9:
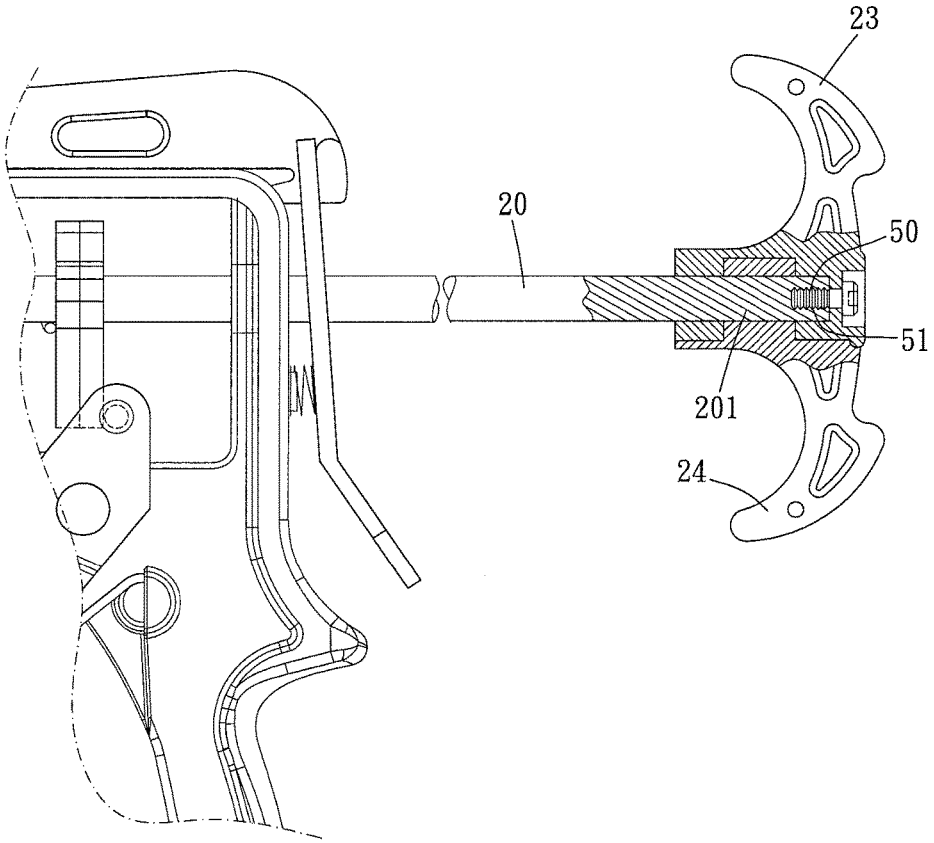
FIG. 9 is a perspective view of another preferred embodiment of the present invention.

In this embodiment, the second hook portion 24 is optionally folded and unfolded relative to the first hook portion 23, so as to fold or un-fold the second hook portion 24 and the first hook portion 23 according to needs. For example, when the first and second hook portions 23, 24 are folded, it is easy to storage and to hang, as shown in FIG. 8; when the first and second hook portions 23, 24 are un-folded, the fingers can buckle in the first and second hook portions 23, 24, so as to operate easily, as shown in FIG. 9.

Furthermore, the first hook portion 23 has a first axial portion 25, the second hook portion 24 has a second axial portion 26. The pushing rod 20 is disposed through the first axial portion 25 and the second axial portion 26. At least one of the first axial portion 25 and the second axial portion 26 is pivoted to the pushing rod 20 to rotate with respect to the other of the first axial portion 25 and the second axial portion 26. Thus, the first and second hook portions 23, 24 can be connected stably to each other, and pivoted to each other. In other embodiment, the first hook portion and the second hook portion can be pivoted to each other, and the pushing rod can be disposed through one of the first hook portion and the second hook portion.

Besides, the first axial portion 25 defines an axis, the first axial portion 25 has a restricting wall 254 extending radially outwardly therefrom. The second hook portion 24 is pivoted to the first axial portion 25 for rotating around the axis, and is stopped by the restricting wall 254, so as to limit a rotated range that the second hook portion 24 is rotated to the first hook portion 23.

Specifically, the first axial portion 25 has two tubular sections 251 arranged along the axis, and a concave 252 disposed between the two tubular sections 251. The second axial portion 26 is a tubular body and is received in the concave 252. The pushing rod 20 is disposed through the two tubular sections 251 and the tubular body. Thus, the second hook portion 24 can be stably pivoted with respect to the first hook portion 23, and cannot slide in an axial direction. Preferably, the second hook portion 24 has a hook sheet 27 extending laterally outwardly therefrom. Wherein, the hook sheet 27 can be flexible. The hook sheet 27 is movable to the first axial portion 25 in a circumferential direction. One of the hook sheet 27 and the first axial portion 25 has a recess, the other of the hook sheet 27 and the first axial portion 25 has a convex engaged within the recess, so as to position the hook sheet 27 in a predetermined location. In this embodiment, the hook sheet 27 has the convex 271, and the first axial portion 25 has the recess 253. In other embodiment, the hook sheet and the first axial portion can be hooked to each other in a hook structure, a ring buckle, or other hook structures to position the hook sheet.

The hook pull portion 22 is removably connected with pushing rod 20, so as to storage and change another hook pull portion or pushing rod more easily. Specifically, the hook pull portion 22 has a through hole 28. The through hole 28 includes a small diameter hole 281 and at least one big diameter hole. The pushing rod 20 has a connecting end portion 201 disposed through the at least one big diameter hole, the connecting end portion 201 and the hook pull portion 22 are connected to each other through a connection member 30. The pushing rod 20 and the connection member 30 are respectively abutted against two end edges which are disposed on two opposite sides of the small diameter hole 281, so as to tightly connect to each other. In this embodiment, a number of the at least one big diameter hole is two. The two big diameter holes 282, 283 are respectively disposed on opposite two sides of the small diameter hole 281. The connection member 30 is received in one of the two big diameter holes 282, 283, such as the big diameter hole 283. Preferably, the caulking gun 1 further includes a cap 40, the cap 40 is disengageably connected to the hook pull portion 22, and the connection member 30 is disposed between the cap 40 and the hook pull portion 22. Specifically, the cap 40 is closably connected with one of the two big diameter holes, such as the big diameter hole 283, to close the connection member 30 inside, so as to prevent the connection member 30 from exposing outside to slash a body of user, or be damaging by outer force. One of the connecting end portion 201 and the connection member 30 has a screw hole, the other of the connecting end portion 201 and the connection member 30 has a thread section disposed through the small diameter hole 281 and screwed into the screw hole. In this embodiment, the connecting end portion 201 has the thread section 50, the connection member 30 is a screw nut having a screw hole 51. In other embodiment, as shown in FIG. 9, the connecting end portion 201 has the screw hole 51, the connection member 30 is a screw having the thread section 50.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A caulking gun, including:

a gun body, including a cartridge holder, the cartridge holder being adapted for receiving a caulk cartridge;

a pushing rod, movably assembled to the gun body and extending into the cartridge holder, the pushing rod having a pushing portion which is movable within the cartridge holder and is adapted for pushing the caulk cartridge, and a hook pull portion connected with the piston portion, the hook pull portion including a first hook portion and a second hook portion, at least one of the first hook portion and the second hook portion being movable to the other of the first hook portion and the second hook portion;

wherein the second hook portion is optionally folded and unfolded relative to the first hook portion.

2. The caulking gun of claim 1, wherein the hook pull portion is removably connected with the pushing rod.

3. A caulking gun, including:

a gun body, including a cartridge holder, the cartridge holder being adapted for receiving a caulk cartridge;

a pushing rod, movably assembled to the gun body and extending into the cartridge holder, the pushing rod having a pushing portion which is movable within the cartridge holder and is adapted for pushing the caulk cartridge, and a hook pull portion connected with the piston portion, the hook pull portion including a first hook portion and a second hook portion, at least one of the first hook portion and the second hook portion being movable to the other of the first hook portion and the second hook portion;

wherein the second hook portion is pivotably connected with the first hook portion.

4. The caulking gun of claim 1, wherein the first hook portion has a first axial portion, the first axial portion defines an axis, the first axial portion has a restricting wall extending radially outwardly therefrom, and the second hook portion is pivoted to the first axial portion for rotating around the axis, and is stopped by the restricting wall.

5. A caulking gun, including:

a gun body, including a cartridge holder, the cartridge holder being adapted for receiving a caulk cartridge;

a pushing rod, movably assembled to the gun body and extending into the cartridge holder, the pushing rod having a pushing portion which is movable within the cartridge holder and is adapted for pushing the caulk cartridge, and a hook pull portion connected with the piston portion, the hook pull portion including a first hook portion and a second hook portion, at least one of the first hook portion and the second hook portion being movable to the other of the first hook portion and the second hook portion;

wherein the first hook portion has a first axial portion, the second hook portion has a second axial portion, the pushing rod is disposed through the first axial portion and the second axial portion, and at least one of the first axial portion and the second axial portion is pivoted to the pushing rod to rotate with respect to the other of the first axial portion and the second axial portion.

6. The caulking gun of claim 1, wherein the hook pull portion has a through hole, the through hole includes a small diameter hole and at least one big diameter hole, the pushing rod has a connecting end portion disposed through the at least one big diameter hole, the connecting end portion and the hook pull portion are connected to each other through a connection member, and the pushing rod and the connection member are respectively abutted against two end edges which are disposed on two opposite sides of the small diameter hole.

7. The caulking gun of claim 6, wherein one of the connecting end portion and the connection member has a screw hole, the other of the connecting end portion and the connection member has a thread section disposed through the small diameter hole and screwed into the screw hole.

8. The caulking gun of claim 6, further including a cap, the cap being disengageably connected to the hook pull portion, and the connection member being disposed between the cap and the hook pull portion.

9. The caulking gun of claim 7, wherein the hook pull portion is removably connected with the pushing rod; the second hook portion is pivotably connected with the first hook portion; the first hook portion has a first axial portion, the first axial portion defines an axis, the first axial portion has a restricting wall extending radially outwardly therefrom, the second hook portion is pivoted to the first axial portion for rotating around the axis, and is stopped by the restricting wall; a number of the at least one big diameter hole is two, the two big diameter holes are respectively disposed on opposite two sides of the small diameter hole, the connection member is received in one of the two big diameter holes; the caulking gun further includes a cap, the cap is closably connected with one of the two big diameter holes to close the connection member inside; the second hook portion has a second axial portion, the pushing rod is disposed through the first axial portion and the second axial portion, and at least one of the first axial portion and the second axial portion is pivoted to the pushing rod to move with respect to the other of the first axial portion and the second axial portion; the first axial portion has two tubular sections arranged along the axis, and a concave disposed between the two tubular sections, the second axial portion is a tubular body and is received in the concave, the pushing rod is disposed through the two tubular sections and the tubular body; and the second hook portion has a hook sheet extending laterally outwardly therefrom, the hook sheet is movable to the first axial portion in a circumferential direction, one of the hook sheet and the first axial portion has a recess, the other of the hook sheet and the first axial portion has a convex engaged within the recess.

* * * * *